United States Patent [19]

Nakazawa

[11] Patent Number: 5,029,332

[45] Date of Patent: Jul. 2, 1991

[54] EXPOSURE COMPENSATION APPARATUS FOR A RADIOGRAPHIC EQUIPMENT

[75] Inventor: Masayuki Nakazawa, Hachioji, Japan

[73] Assignee: Konica Corporation, Tokyo, Japan

[21] Appl. No.: 492,916

[22] Filed: Mar. 13, 1990

[30] Foreign Application Priority Data

Mar. 14, 1989 [JP] Japan ..... 1-59698

[51] Int. Cl.[5] ..... G21K 1/04

[52] U.S. Cl. ..... 378/145; 378/146; 378/147; 378/148; 378/151

[58] Field of Search ..... 378/145, 146, 147, 148, 378/149, 150, 151, 152, 159, 158, 116, 154, 96, 97, 113

[56] References Cited

U.S. PATENT DOCUMENTS 4,868,857 9/1989 Dobbins, III ..... 378/159

4,882,741 11/1989 Brown ..... 378/152

4,953,189 8/1990 Wang ..... 378/146

*Primary Examiner*—Edward P. Westin

*Assistant Examiner*—Don Wong

*Attorney, Agent, or Firm*—Finnegan, Henderson, Farabow, Garrett and Dunner

[57] ABSTRACT

An exposure compensation apparatus for use in a radiographic equipment to modulate local intensity of radiation. The exposure compensation apparatus comprises a detecting means to detect transmittance of radiation at a location of a radiated object, right-left reversion means to reverse a location arrangement of the transmittance data on a line of a predetermined direction, an averaging means to average a pair of the original and reversed transmittance data of a location to acquire an averaged transmittance, and a local intensity control means to control a local intensity compensation means of the radiographic equipment.

4 Claims, 11 Drawing Sheets

EXPOSURE COMPENSATION APPARATUS FOR A RADIOGRAPHIC EQUIPMENT

BACKGROUND OF THE INVENTION

This invention relates to an exposure compensation apparatus for use in a radiographic equipment for medical diagnosis.

In conventional radiographic apparatus, a radiation source applies radiation, generally X-rays, to an object, generally a covered organ in a living human body, to form and record an image of the object on an image screen, such as an screen-film installed behind the object.

In X-ray diagnosis, however, the object, a chest for example, has extremely great variations in anatomical thickness and tissue hardness, thus causing a great deal of variance of X-ray absorption by portions of the object.

As a result, only a small part of the object image is provided with an appropriate exposure amount and a greater part of the image is out of the proper exposure range, and this causes a large loss of image information, namely a large loss in diagnosis value.

To meet the above situation a local intensity modulator is installed between the radiation source and the object, and is used for the purpose of modulating the intensity of the radiation to each location of the object, whereby the modulation is based on transmittance datum of each location measured by test radiation that is radiated before or at substantially the same time of said radiation, as referred to in the Japanese patent publication Nos. 1987-129034 and 1988-189853.

OBJECT OF THE INVENTION

It has been empirically recognized that in an X-ray diagnosis of an organ of a human body having a symmetrical form in relation to a line of symmetry, a density difference of a radiographic image between corresponding right and left locations of the organ is sometimes a key to finding a focal area of a diseased organ. A lung is a typical example.

A conventional compensation apparatus, however, has a disadvantage in that even if the original image of the organ has the assymmetric density distribution showing the presence of the diseased area, density difference between the corresponding right and left portions is equalized by the compensation. This increases the difficulty in diagnosis and may cause a wrong diagnosis.

The object of the present invention is to provide a radiographic equipment having a local compensation capability which retains the original density difference between the corresponding locations of the organ to avoid making the wrong diagnosis above mentioned.

SUMMARY OF THE INVENTION

This invention is directed to the provision of an exposure compensation apparatus of a radiographic apparatus to control a local intensity modulator of the radiographic apparatus comprising a detecting means to measure original transmittance of each location of an object, a right-left reversion means to reverse an arrangement of the locations in the original transmittance data of the corresponding locations in a predetermined direction, an averaging means for obtaining an averaged transmittance by averaging the original data and the reversed data, and a control means to control the local intensity modulator of the radiographic apparatus according to the averaged control signal from the averaging means.

In the above configuration of the invention, the original locations of transmittance in the predetermined direction is reversed in relation to a center line of symmetry, the transmittance data and the reversed data are then averaged in relation to each pair of corresponding symmetrical locations of the image to generate an averaged local compensation signal, and thus the compensation based on the averaged compensation signal has a symmetric characteristic in the predetermined direction.

BRIEF DESCRIPTION OF THE DRAWING

FIGS. 3-1, 3-2, and 3-3 show embodiments of a transmittance detection means; FIGS. 4-1 and 4-2 show structures of a local intensity modulator; FIGS. 10-1, 10-2, and 10-3 show control examples when the R-L reversion processing 12 and the mean processing 13 in FIG. 1 are not performed; FIGS. 11-1, 11-2, 11-3, 11-4, and 11-5 show control examples when the R-L reversion processing and the mean processing are performed.

DETAILED DESCRIPTION OF THE INVENTION

Figure 2:
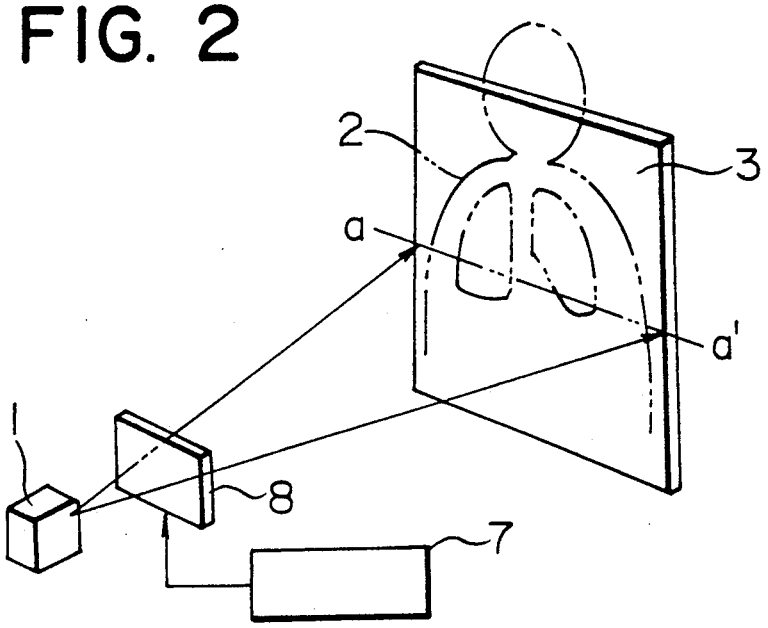
FIG. 2 is a perspective view of radiographic equipment.

In a radiographic equipment as shown in FIG. 2, X-ray radiation is applied to an object 2 from the radiation source 1, and an image is formed and recorded according to the intensity of transmitted radiation by the screen-film 3 installed behind the object 2.

The screen-film 3 is a combination of a fluorescent layer and a photosensitive film coated with a silver-salt photosentisizer, wherein the former converts the X-rays to visible rays to be recorded on the film. The radiographic process of the invention consists of two steps.

In the first step, a weak and constant radiation is a applied to the object 2 from the radiation source 1 and intensity of transmitted radiation is measured at each location of the image to be used as transmittance data of the object later.

In the second step, a strong and compensated radiation is applied to the object 2 from the radiation source 1 to form and record an image of the object 2 on the screen-film 3 to be used for diagnosis.

Figure 1:
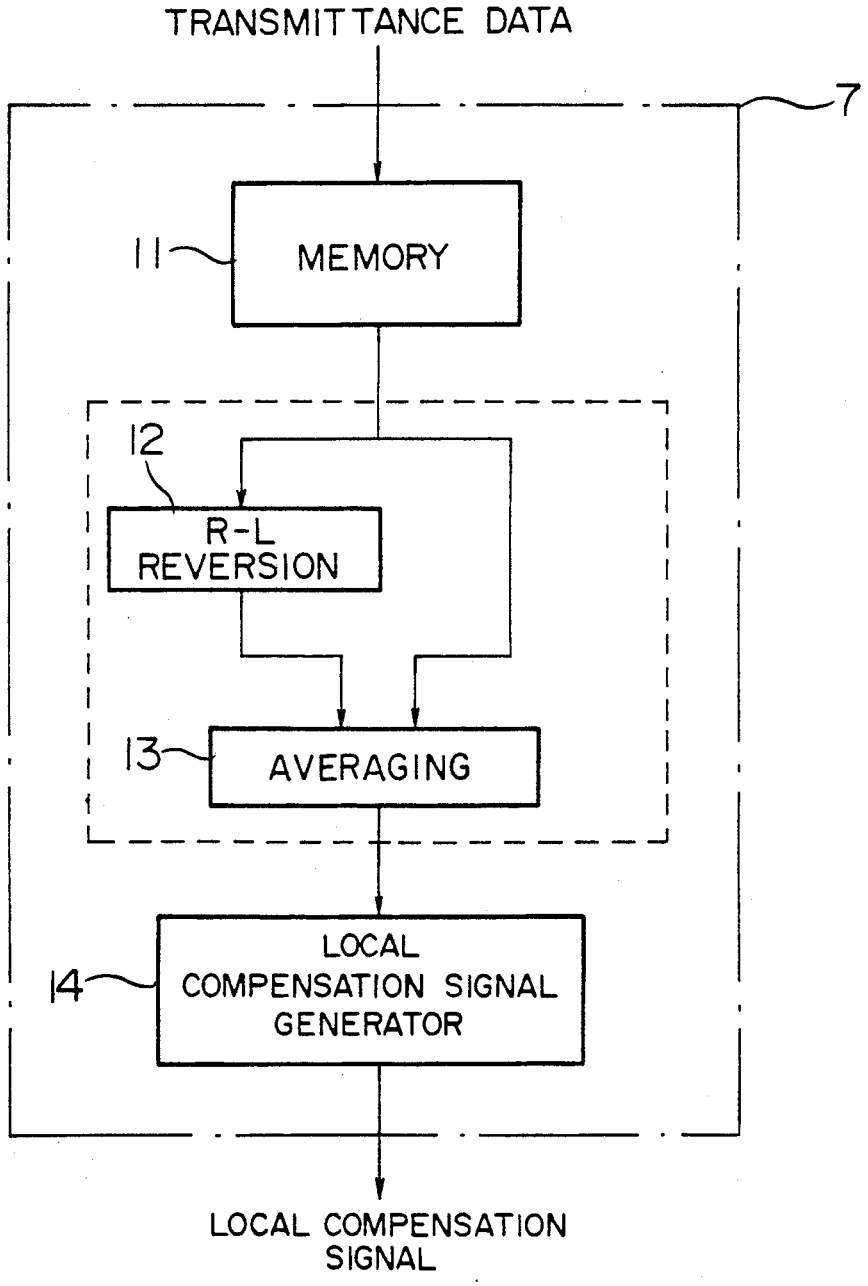
FIG. 1 is a block diagram of a control unit indicating an embodiment of the present invention.
Figures 1, 3:
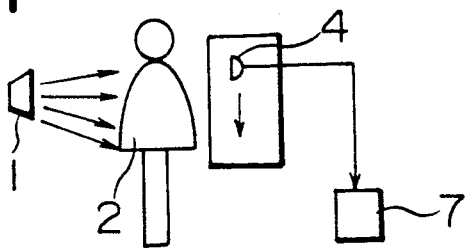
Figures 2, 3:
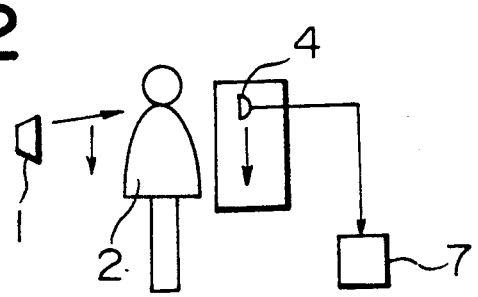
Figure 3:
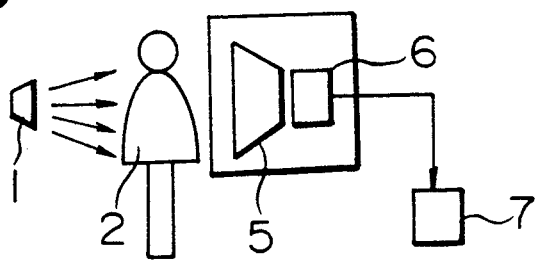

As a transmittance detection means in the first step, a line detector 4 is installed behind the object 2 as shown in FIG. 3-1, the transmittance at each part of the object 2 is detected by scanning the line detector 4, and the detection results are stored in a memory of a control unit 7. When a radiation fan beam generator is used as a radiation source 1 as shown in FIG. 3-2, the line detector 4 may be scanned in synchronization with a fan beam generated from the radiation fan beam generator.

As shown in FIG. 3-3, the image intensifier 5 may be used instead of the line detector 4 so as to intensify the image of the object 2, and the image is then scanned TV camera 6 to be stored in a memory of the control unit 7 as the transmittance data. The radiation for such data storage may be weak as mentioned above, and the space resolution of the line detector 4 and of the TV camera 6 may be low.

As a local compensation means in the second step, the local compensation unit 8 is installed between the radiation source 1 and the object 2 as shown in FIG. 2, and the local compensation unit 8 is controlled by the control unit 7.

As an example, as shown in FIG. 2, when the object 2 is a human chest and a fan beam is used to radiate the object 2 on a line area a-a' to form and record an image on the screen-film 3, the local intensity modulator 8 is controlled so as to lower the radiation intensity to that for a lung part, compared with the intensity for other parts, based on the transmittance data stored in the control unit 7.

Figures 1, 4:
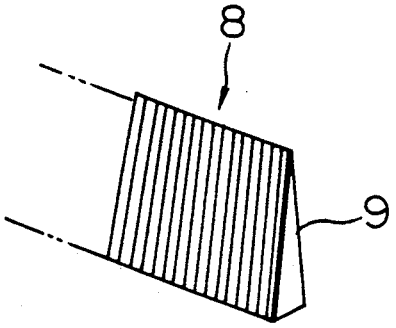
Figures 2, 4:
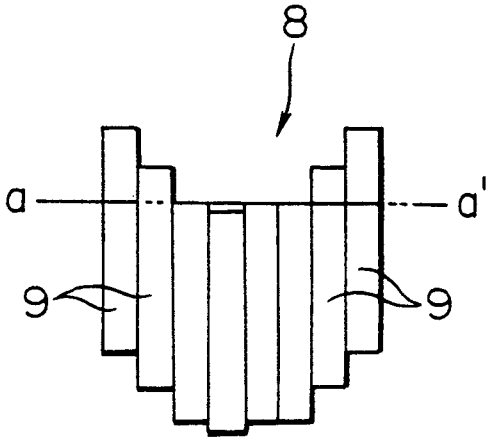
Figure 5:
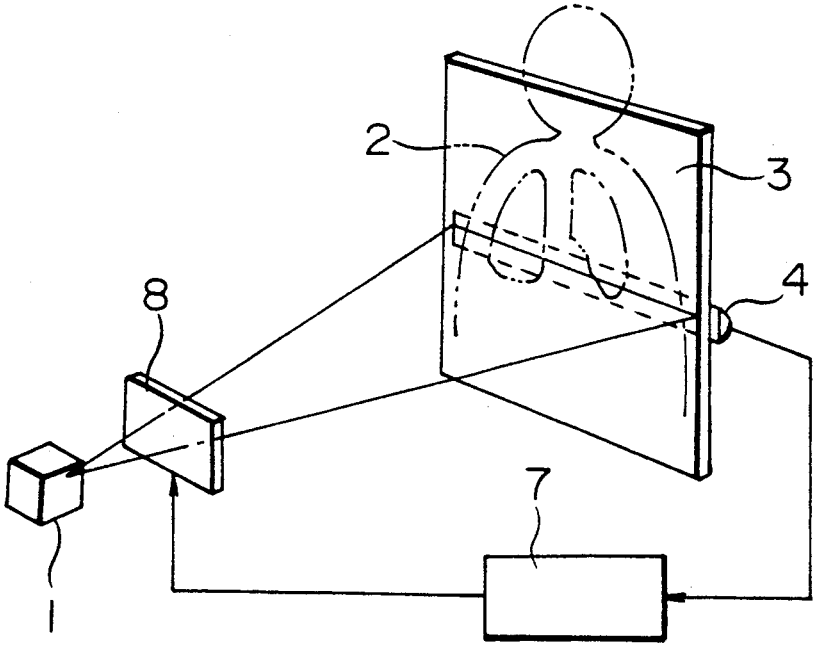
FIG. 5 is a perspective view of another embodiment of radiographic equipment.

An example of the structure of the local intensity modulator 8 is shown in FIG. 4-1 and 4-2. A plurality of the wedge-shaped blades 9 of a radiation-absorptive substance is stacked in one row as in FIG. 4-1, and each blade moves above and under the fan beam path a-a' as in FIG. 4-2, so as to locally modulate the intensity of radiation. It is desirable that the number of blades 9 is equal to the number of pixels of the line detector 4. Therefore, when the number of pixels of the line detector 4 is 2000, the maximum number of blades is 2000. When the spacial frequency of the compensation is lowered by the averaging processing, necessary number of blades which can respond t the spacial frequency is also lowered. When the number of compensation pixels is reduced to 100 by averaging, for example, 100 sheets of blades is large enough. As shown in FIG. 5, the detection of the transmittance at each part of the object 2 may be performed simultaneously with the compensation of the radiation intensity according to the detected data during image formation wherein the radiation through the object 2 is applied to the screen film 3. In this case the object 2 is located in front of the screen film 3 from the beginning, and the object 2 is scanned on the screen film 3 by the radiation fan beam generated by radiation source 1. Simultaneously, the transmittance at each part is detected by the line detector 4 which moves synchronizing with the scan of the fan beam behind the screen film 3, the detected transmittance is immediately fed back to the local intensity modulator 8 via the control unit 7, and an image is formed on the screen film by one scanning with the local compensation of compensating the radiation intensity at each location of the object 2. When this method is used, a pencil beam may be used instead of the fan beam.

The configuration of the control unit 7 related to the present invention will be described hereunder with reference to FIG. 1. The control unit 7 comprises the memory 11 which stores transmittance data from the line detector 4 or the TV camera 6; the R-L reversion unit 12 which serves as a right-left reversion means for reversing a location arrangement of the transmittance data from the memory 11; the averaging unit 13 which serves as an averaging means for overlapping and averaging the transmittance data from the memory 11 and the reversed transmittance data from the R-L reversion unit 12, and a local compensation signal generator 14 which generates a local compensation signal from the averaged transmittance data obtained by the averaging unit 13 and controls the local intensity modulator 8 according to the generated result.

An A/D converter and a D/A converter may be additionally used when necessary.

In the series of the above processes, a non-linear conversion process, such as a logarithmic conversion of transmittance data, may be inserted, and both an analog means and digital means ma be used in the above processes.

As another example of the embodiments the original transmittance data from the memory may sequentially pass, sequentially through the local compensation signal generator, R-L reversion unit, and then averaging unit. By this way also, the dynamic range of the image intensity can be compressed.

Next, the function of the control unit 7 will be described hereunder.

Figure 6:
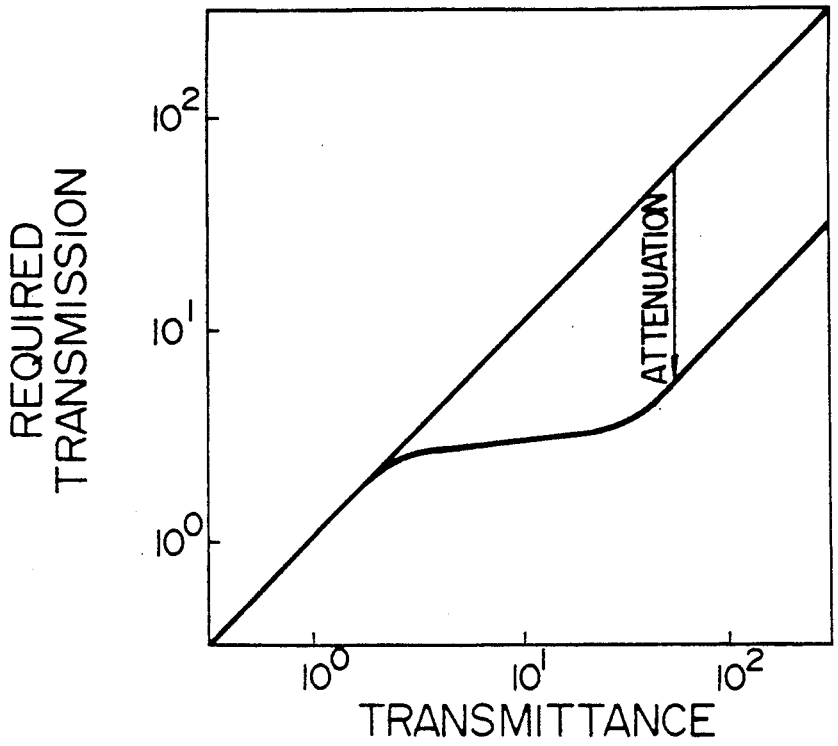
FIG. 6 shows the relationship between transmittance and required transmittance.

FIG. 6 shows the relationship between the transmittance data of the object 2 and the required transmission of radiation for radiography.

Figure 7:
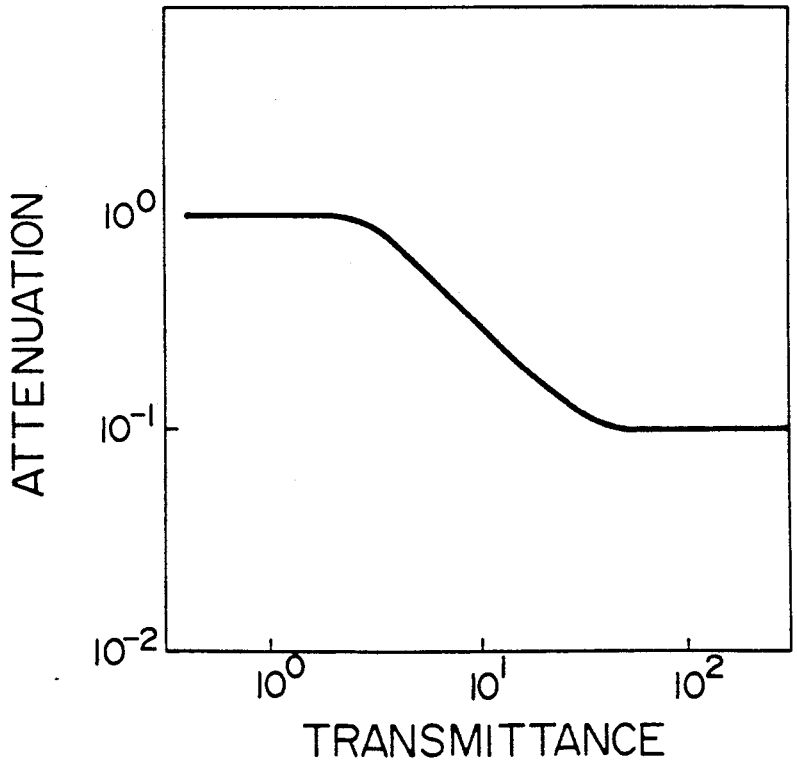
FIG. 7 shows the relationship between transmittance and attenuation.
Figure 8:
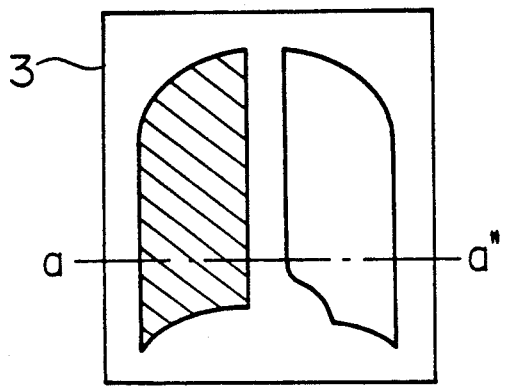
FIG. 8 shows an example of chest radiography.

FIG. 7 shows the relationship between the transmittance data of the object 2 and the required attenuation by the local intensity modulator. The local compensation signal generator 14 generates a local compensation signal base on the relationship in FIGS. 6 and 7 according to the transmittance data at each part of the object 2, and controls the local intensity modulator 8 according to the generated data. The functions of the R-L reversion unit 12 and the averaging means 13 which are performed before starting the above processing are as follows: When a shadow exists in the left lung in FIG. 8 due to a disease in chest radiography and the radiation fan beam is applied on the line a-a' in the figure, the transmittance data from the line detector 4 is as shown in FIG. 9.

Figure 9:
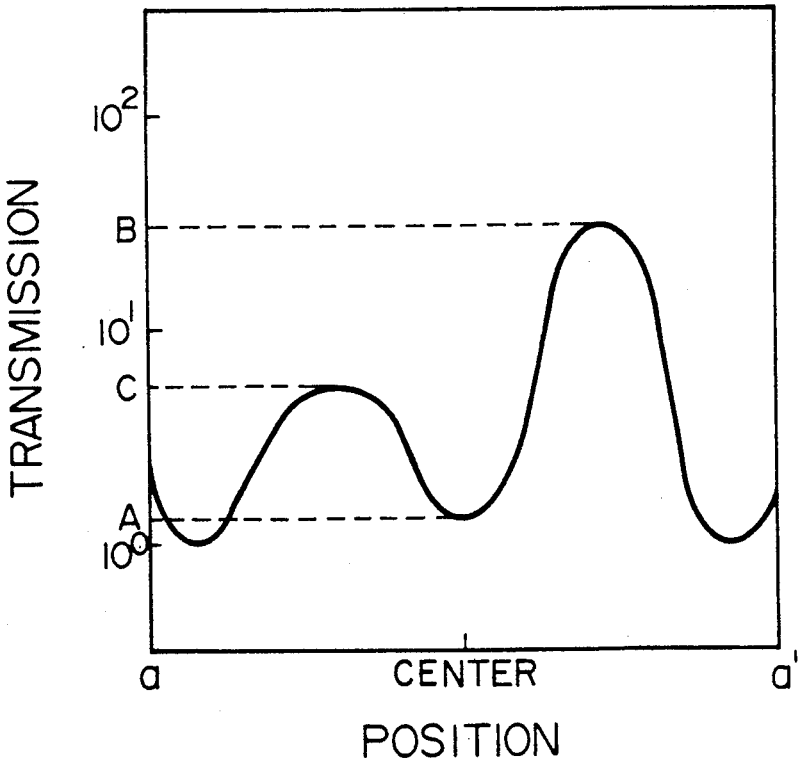
FIG. 9 shows an example of transmittance data.
Figures 1, 10:
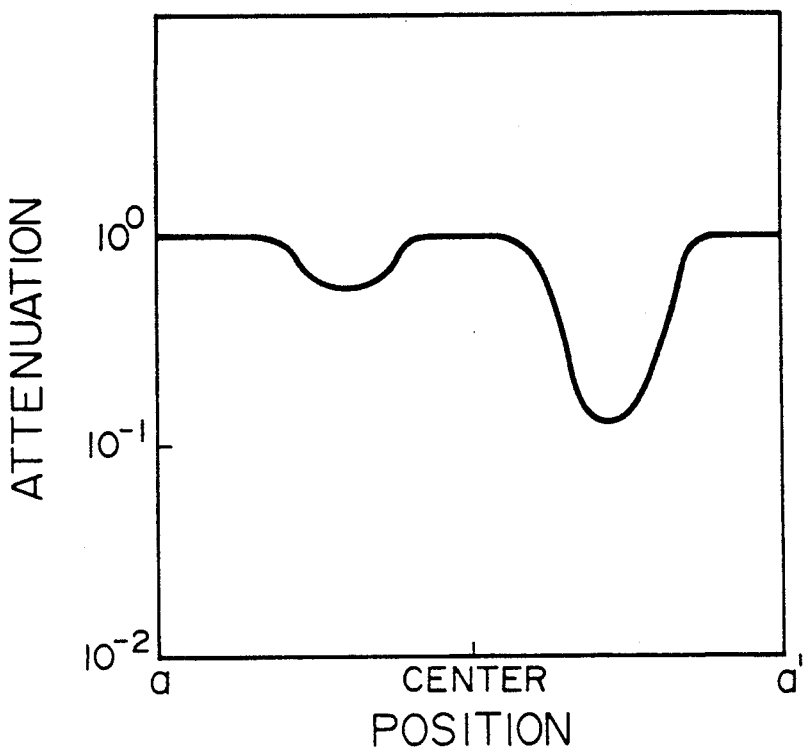
Figures 2, 10:
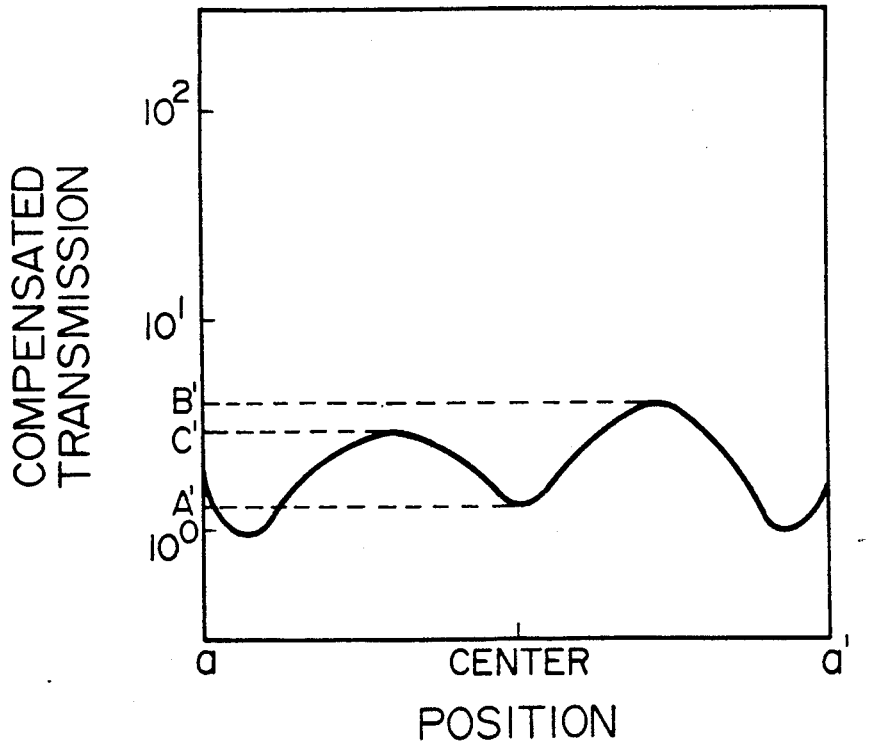
Figures 3, 10:
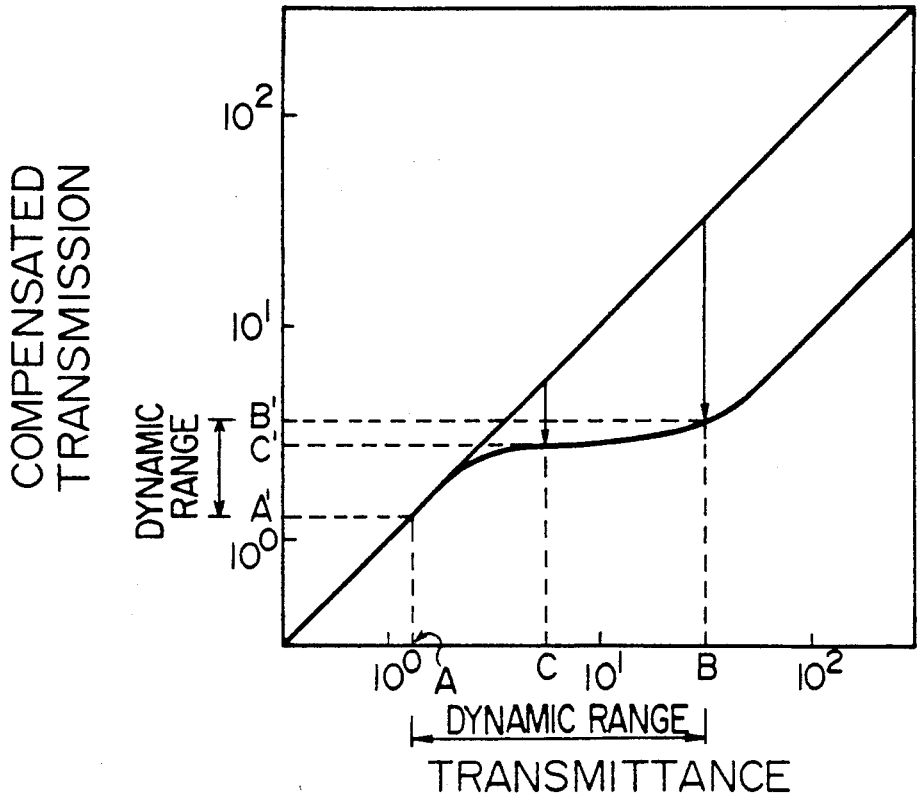

When the transmittance data in FIG. 9 is used as it is, the attenuation by the local intensity modulator 8 is as shown in FIG. 10-1, and resultant intensity of the transmitted radiation distributes as shown in FIG. 10-2. As a result, dynamic range caused by control is as shown in FIG. 10-3. The dynamic range is compressed, but the difference in density between the right and left lungs is hard t detect.

Figures 1, 11:
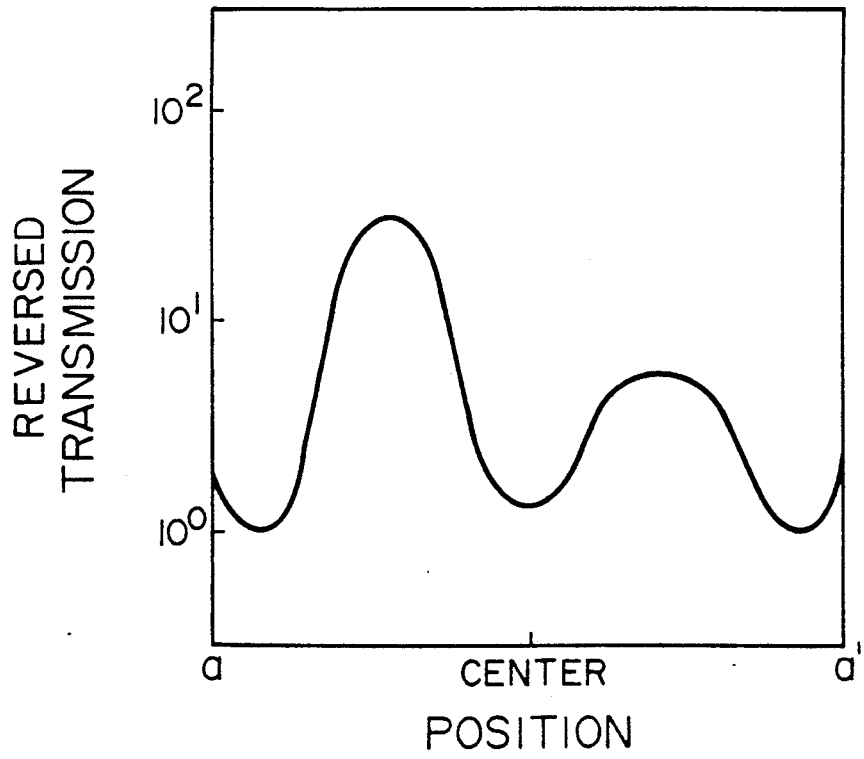
Figures 2, 11:
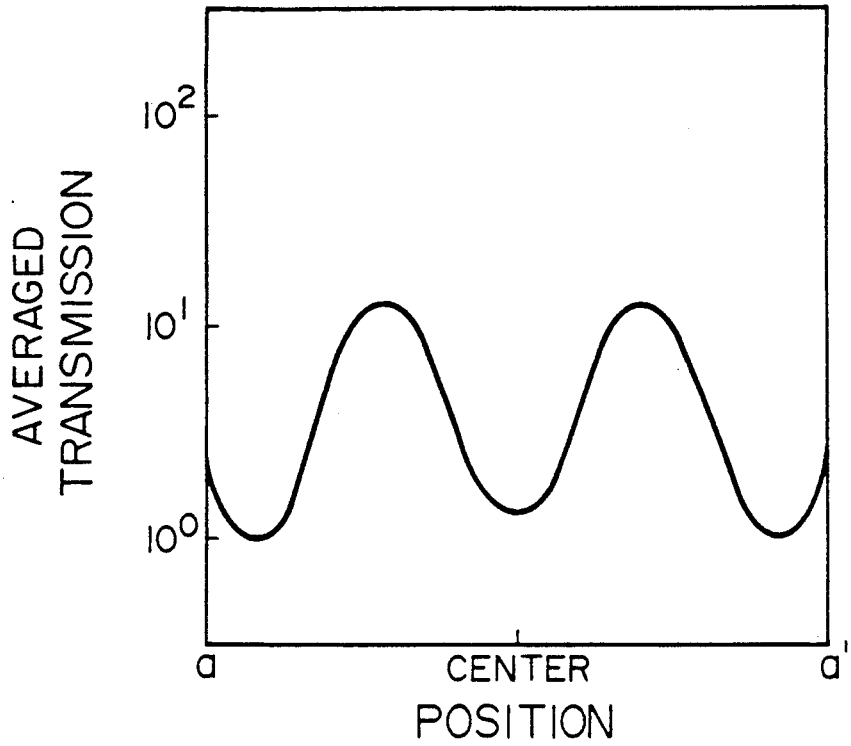
Figures 3, 11:
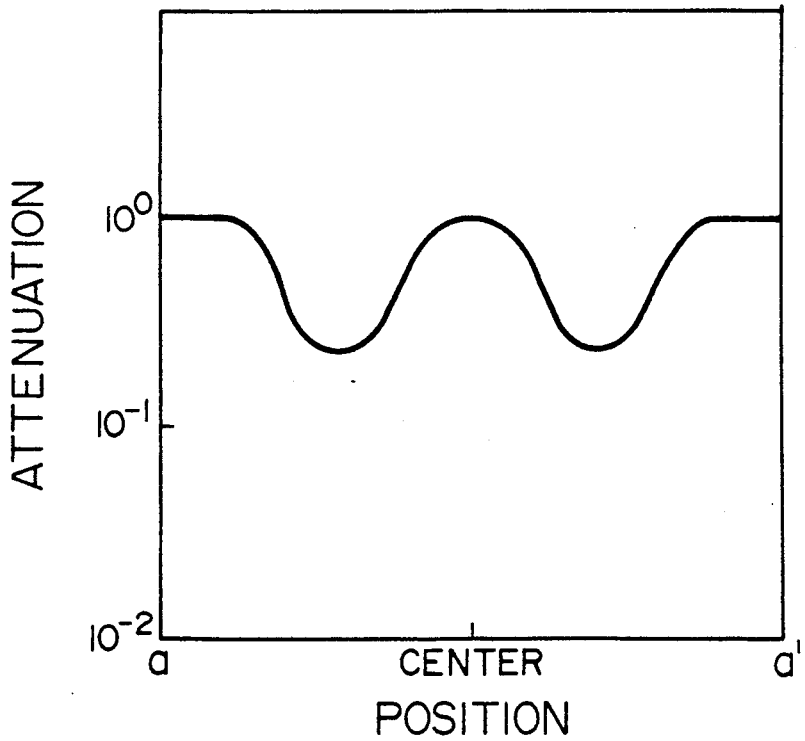
Figures 4, 11:
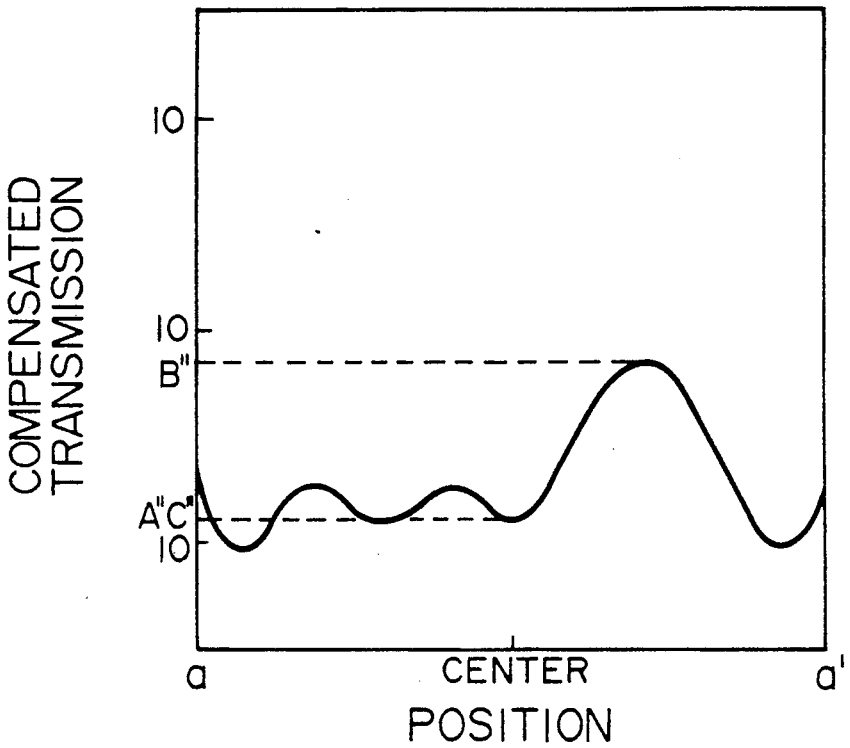
Figures 5, 11:
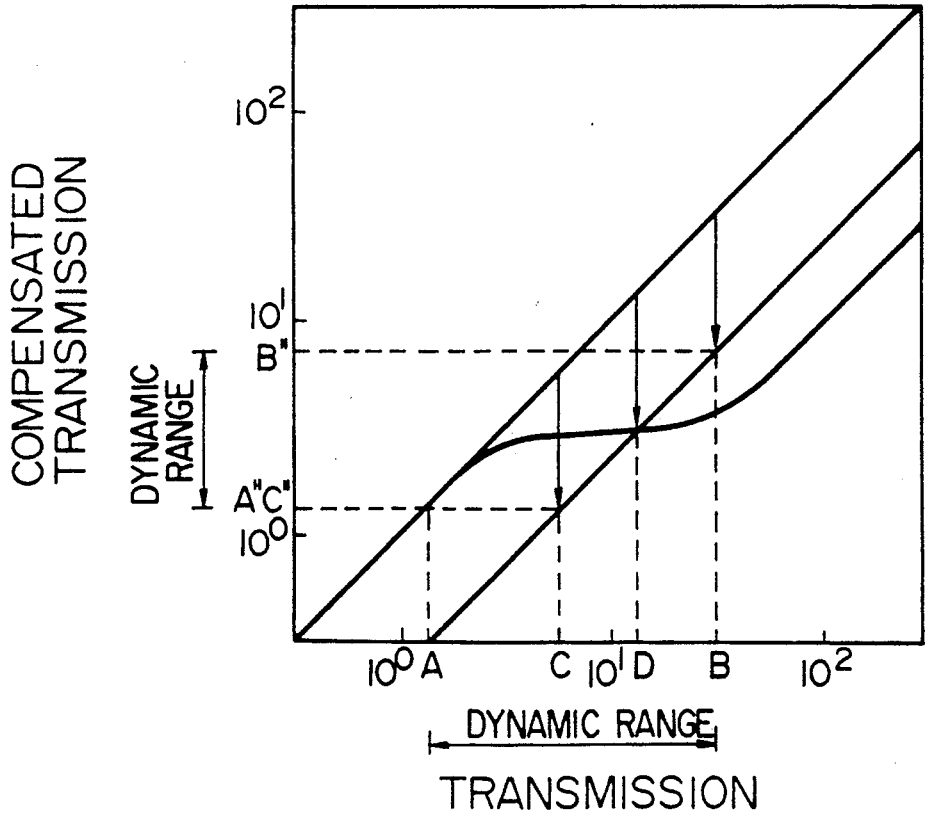

When the R-L reversion unit 12 and the averaging means 13 are used, the results shown in FIGS. 11-1 to 11-5 are obtained.

When the transmittance data from the line detector 4 is as shown in FIG. 9, a signal which is reversed by the R-L reversion unit 12 is as shown in FIG. 11-1. A signal obtained by the averaging means 13 is an average of the transmittances in FIGS. 9 and 11-1, and is as shown in FIG. 11-2.

When the averaged transmittance data in FIG. 11-2 is used, the attenuation by the local compensation unit 8 is as shown in FIG. 11-3 from the relationship in FIG. 7. When the radiation intensity at each part is controlled by the local intensity modulator 8 transmitted radiation distributes as shown in FIG. 11-4.

As a result, the change in dynamic range caused by control is as shown in FIG. 11-5, and the dynamic range is compressed keeping the difference in density between the right and left lungs.

Figure 12:
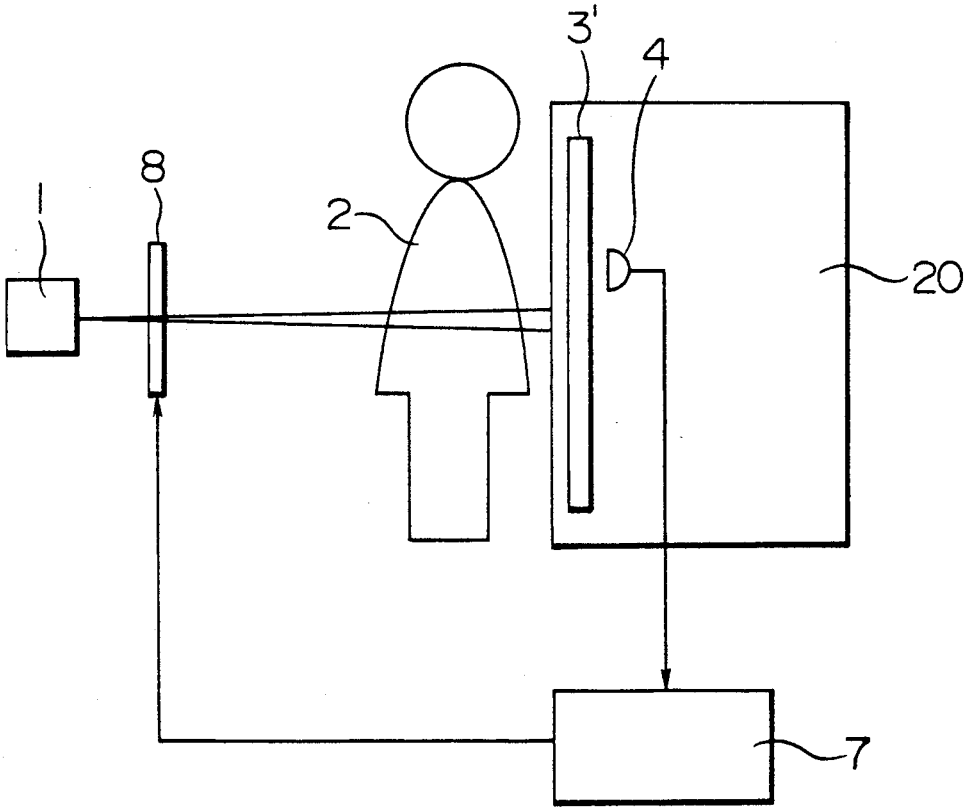
FIG. 12 is a perspective view of a radiographic equipment using an image conversion panel.

In the above embodiments, the screen film 3 is used as an imaging screen. As shown in FIG. 12, however, a radiation image conversion panel 3', for example, made of a photo-stimulated fluorescent material which stores and records radiation images may be used to allow a radiation image reader 20 to read the radiation images.

In this case, the image reader 20 may serve as a line detector 4. When the line detector 4 is used, it is desirable to install the detector between the radiation source 1 and the conversion panel 3'.

The materials indicated hereunder in (i) to (vi) below may be used, for example, as a photo-stimulated fluorescent material used as a radiation image conversion panel.

(i) An alkaline earth halide fluoride fluorescent material indicated by the general expression:

$$(Ba_{1-x-y}Mg_xCa_y)FX:eEu^{2+}$$

described in the Japanese patent publication No. 1980-12143

(ii) A fluorescent material indicated by the general expression:

$$LnOX:xA$$

described in the Japanese patent publication No. 1980-12144

(iii) A fluorescent material indicated by the general expression:

$$(Ba_{1-x}Mg\ x)FX:yA$$

described in the Japanese patent publication No. 1980-12145

(iv) A fluorescent material indicated by the general expression:

$$BaFX\ xCe,\ yA$$

described in the Japanese patent publication No. 1980-84389

(v) A rare earth element activated dihydric metal fluorohalide fluorescent material indicated by the general expression:

$$M^2FX.xA:yLn$$

described in the Japanese patent publication No. 1980-160078

(vi) An alkaline halide fluorescent material indicated by the general expression:

$$(M^1X.aM^2X'_2.bM^3X''_3:cA$$

described in the Japanese patent publication No. 1986-72087

Figure 13:
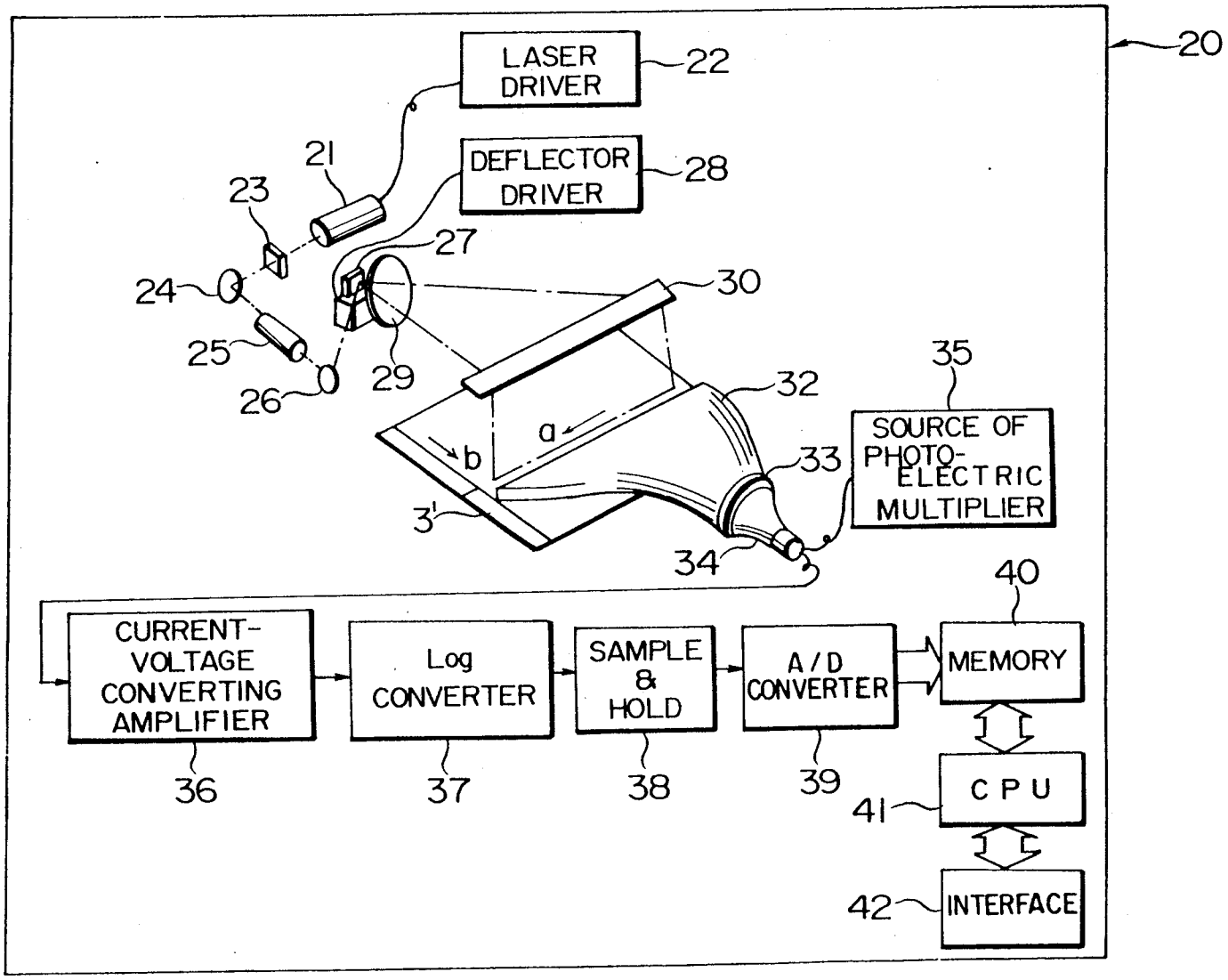
FIG. 13 is a schematic view of an image reader.

FIG. 13 shows an example of the radiation image reader 20.

In the case of FIG. 13, a light source 21 for generating an excitation light, for example, a semiconductor laser beam, is driven by a driver circuit such as the laser driver 22. A beam generated from the light source 21 reaches the deflector 27 via the monochromatic light filter 23, the split mirror 24, the beam shaping optical system 25, and the mirror 26. The deflector 27 comprises a galvanomirror which is driven by the deflector driver 28, and deflects the above beam at a predetermined angle in the scan region. The deflected beam is adjusted by a f$\theta$ lens 29 so that the beam is kept to move at a predetermined speed on the scanning lines, scans on the conversion panel 3', where the dynamic range of the image data which transmits through the object as mentioned above is stored and recorded in a compressed state, in the direction of the arrow "a" via the mirror 30. The conversion panel 3' moves simultaneously in the subscanning direction (in the direction of the arrow b) by an appropriate means to allow for scanning on the overall surface. A photo-stimulated light generated from the conversion panel 3' which is scanned by the above beam is condensed by the condenser 32, and reaches the beam receiving unit 34 comprising a photo-electric converter such as a photo-electric multiplier via the filter 33 which allows only the wave length region of the photo-stimulated light to pass through, and is converted to an analog electric signal (an image signal). A high voltage is supplied to the photo-electric multiplier from the power source 35; an image signal which is generated from the photo-electric multiplier as a current is amplified by the current-voltage converting multiplier 36. A voltage signal thus obtained passes through the Log converter 37 which converts the signal to a light intensity signal and the sample & hold circuit 38, is converted to a digital signal by the A/D converter 39, and is stored in the memory 40. This memory 40 is connected to a CPU 41 which performs digital operations, and the CPU 41 can be connected to external equipment via an interface 42, such as a large scale computer or a minicomputer for storing and processing data, a CRT display for outputting images, or various hard copy creating equipment. The CPU operates and transfers data stored in the memory 40.

For compressing the dynamic range of the image intensity, a control signal from the control unit 7 may be supplied to one of the following units, namely; the laser driver 22, the power source 35 for the photo-electric multiplier, or the current-voltage converting amplifier 36. The image reader 20 may correct the obtained image signal by the signal from the control unit 7.

As mentioned above, the present invention performs exposure compensation by reversing the detected transmittance data in the right and left direction, averages the original data and the right-left reversed data, and controls the radiation intensity at each part of the object according to the averaged data, and so the exposure compensation is symmetrical on the right and left. The difference in density between the right and left parts of an object is kept to make the image clear and the resultant effect is the elimination of a wrong diagnosis.

What is claimed is:

1. An exposure compensation apparatus for use in radiographic equipment, wherein said radiographic equipment has a local intensity modulator capable of modulating the local intensity of radiation, said exposure compensation apparatus comprising:

detecting means for detecting transmittance of radiation through an object at each location of a plurality of locations in the object to be used as original transmittance data;

inverting means for processing a set of original transmittance data representing locations on a line oriented in a predetermine direction to invert the location arrangement of the transmittance data on the line to obtain a mirror image;

averaging means for obtaining an average transmittance by averaging the original transmittance data and the inverted transmittance data of the same location; and local compensation signal generating means for controlling the local intensity modulation of the radiographic equipment, based on the average transmittance.

2. Radiographic equipment for radiating an object, comprising:

means for directing radiation at the object;

means for detecting radiation transmitted through the object;

means for inverting transmittance data representing the radiation transmission along a line transverse to the directed radiation to form inverted data representing a mirror image of the radiation transmission along the line;

means for averaging the transmittance data and the inverted data to obtain averaged data; and means for varying the radiation exposure of the object based upon the averaged data.

3. The radiographic equipment of claim 2, wherein the transmittance data along a line is along a horizontal line.

4. A method for controlling the intensity of radiographic equipment, comprising the steps of:

directing radiation towards an object;

detecting radiation transmitted through the object;

representing a line of detected radiation as transmittance data;

transposing the transmittance data to obtain a mirror image;

averaging the transmittance data and the transposed transmittance data to produce averaged transmittance data; and adjusting the directed radiation based upon the averaged transmittance data.

* * * * *